United States Patent [19]

Miller

[11] Patent Number: 4,497,314

[45] Date of Patent: Feb. 5, 1985

[54] ANKLE SUPPORTING DEVICE FOR INVERTED POSTURE

[75] Inventor: Jack V. Miller, Sierra Madre, Calif.

[73] Assignee: Gravity Guidance, Inc., Duarte, Calif.

[21] Appl. No.: 446,482

[22] Filed: Dec. 2, 1982

[51] Int. Cl.[3] ..... A61H 1/02

[52] U.S. Cl. ..... 128/75; 272/145; 272/900

[58] Field of Search ..... 272/33 R, 62, 144-145, 272/900; 128/75, 24 R, 80 R-80 J, 87 R-87 C, 85, 88, 89 R, 89 A, 90, 581, 133, 132 R; 2/2, 22; 248/215, 218.4, 225.3 A, 226.5, 227, 305, 316 C, 316 D; 24/230.5 R; D21/221, 223; 150/52 G

[56] References Cited

U.S. PATENT DOCUMENTS

| | | | |
|---|---|---|---|
| D. 242,497 | 11/1976 | Haggerty | 150/52 G X |
| 1,529,546 | 3/1925 | McKenzie | 132/73 X |
| 3,380,447 | 4/1968 | Martin | 128/75 |
| 3,415,244 | 12/1968 | Block | 2/2 X |
| 3,621,489 | 11/1971 | Keller | 2/22 |
| 4,290,523 | 9/1981 | Wallace | 220/339 X |
| 4,382,439 | 5/1983 | Shen | 128/89 R X |

*Primary Examiner*—Robert A. Hafer
*Assistant Examiner*—Chris Coppens
*Attorney, Agent, or Firm*—Zarley, McKee, Thomte, Voorhees & Sease

[57] ABSTRACT

An ankle supporting device for suspending a human in inverted posture is provided in which a generally U-shaped ankle-encircling member is configured to slip over a human ankle with the base of the U oriented towards the heel of the user's foot, and the ends of the U positioned over the metatarsal arch and including integral hooks so oriented as to be engagable with a horizontal bar with the user in inverted posture.

8 Claims, 3 Drawing Figures

ANKLE SUPPORTING DEVICE FOR INVERTED POSTURE

BACKGROUND OF THE INVENTION

This invention relates to an ankle-supporting device for suspending a human in inverted posture from a fixed support, such as a horizontal bar. This type of device is known, and is described in U.S. Pat. No. 3,380,447 (Martin). Such devices are employed in medical practice to treat certain health conditions in traction apparatus.

SUMMARY OF THE INVENTION

This invention provides an ankle-supporting device in which a U-shaped ankle-encircling device slips over the ankle of a user with the base of the U oriented towards the heel of the user and the legs of the U projecting forward over the metatarsal arch and terminating in integral hooks which are engagable with a horizontal bar with the user in inverted posture. Although a locking means may be provided to hold the ends of the U in mutual contact and the ankle-encircling member snug on the user's ankle, a positive lock is incorporated into the device by the engagement of the hooks on a horizontal bar, whereby the ankle-encircling member is contoured to closely match the size and shape of the ankle, and the ankle may not be released with both hooks engaged on the horizontal bar.

An object of the invention is to ensure foolproof locking of the ankle holder to the user's ankle.

Another object of the invention is to provide an ankle-encircling member which is closely contoured to fit the ankle with a relatively thin layer of resilient padding, thereby distributing the load over a large area with nearly uniform pressure and improved comfort.

Another object of the invention is to provide an ankle-supporting device for inverted posture which may be manufactured in quantity at low cost.

To the above ends the invention provides an ankle-supporting device in the general shape of a U which is contoured to match the shape of the human ankle, and in which the legs of the U are resiliently urged together whereby the legs are pulled apart elastically to slip them over the user's ankle. The ends of the U are in the form of integral hooks that are oriented so as to engage a horizontal bar with the user in inverted posture and suspended by the ankle-supporting devices, whereby the user's ankles are retained as long as the hooks are engaged with the horizontal bar.

The ankle-supporting device is formed of a single and unitary structural element, such as a resilient plastic, without resorting to the prior art use of a hinge and lock to securely retain the ankle.

DETAILED DESCRIPTION OF THE DRAWINGS

Figure 1:
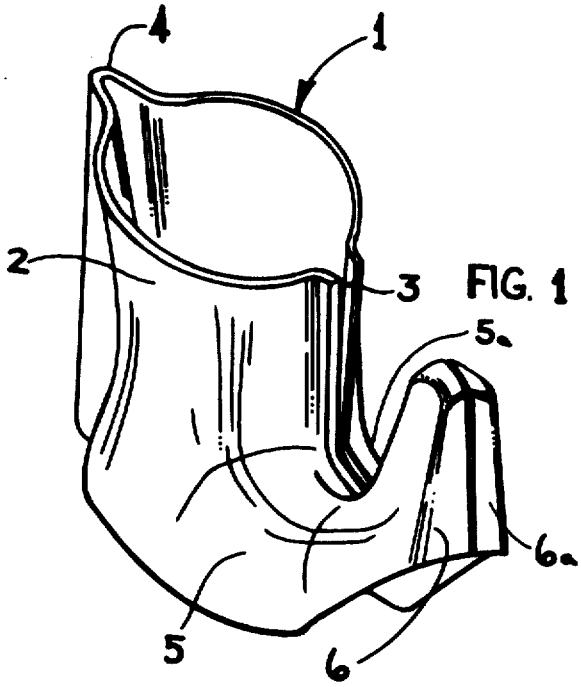
FIG. 1 is a perspective view of an ankle-supporting device according to the invention.

In FIG. 1 an ankle-supporting device 1 is shown having a generally cylindrical tubular clamp 2 which has a longitudinal anterior slit 3 and an integral posterior flexure portion 4. Anterior extensions 5 and 5*a* project from each respective edge of slit 3 and terminate in hooks 6 and 6*a*, respectively, which are open in the proximal direction.

Figure 2:
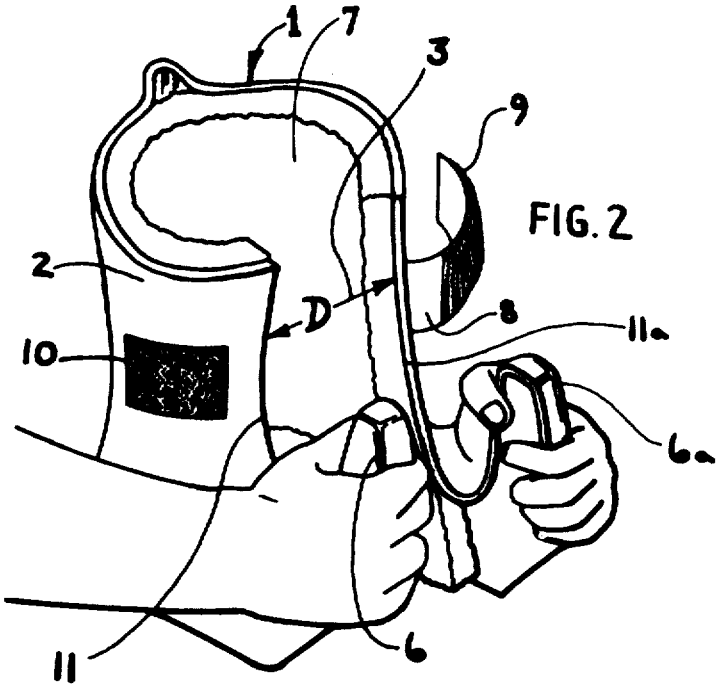
FIG. 2 is a perspective view of the ankle-supporting device of FIG. 1 shown being drawn open for placement on a human ankle.

In FIG. 2 the ankle-supporting device 1 is shown being manually pulled open a sufficient distance D of at least the width of a human ankle. Interior padding 7 is shown lining clamp 2 to distribute the pressure on the ankle of the user. A locking means is optionally provided having a catch portion 9 and a hook portion 10 attached to opposite sides of clamp 2 whereby the catch 9 may be engaged with the hook 10 to hold slit 3 in the closed position with edges 11 and 11*a* in abutment and hooks 6 and and 6*a* juxtaposed.

Figure 3:
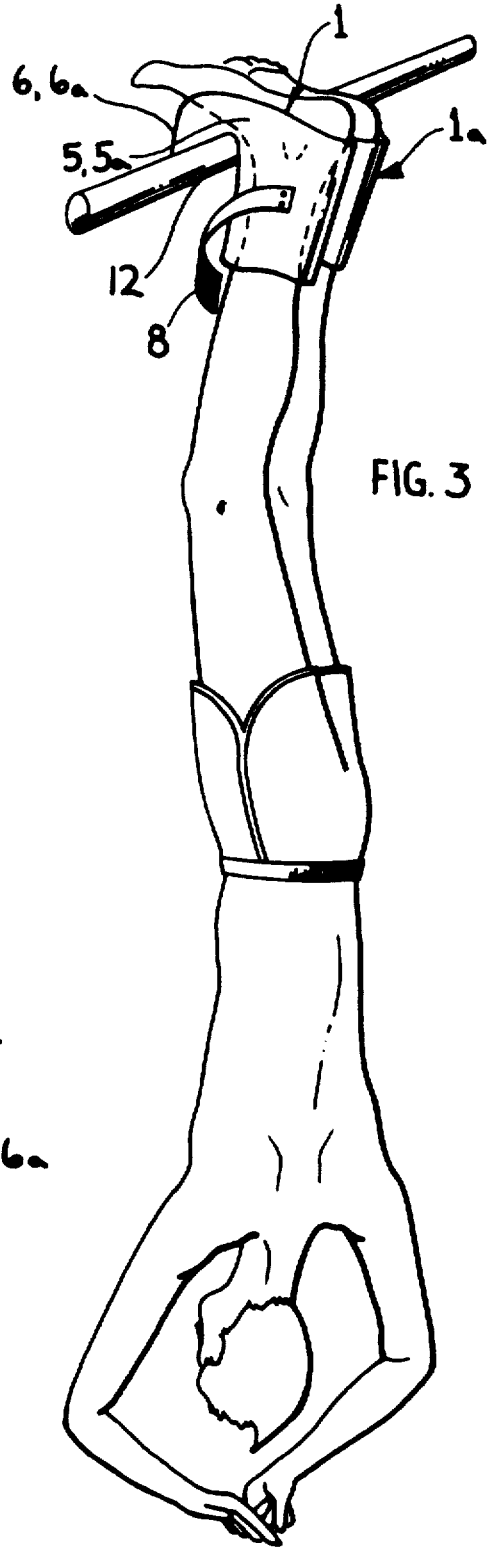
FIG. 3 is an elevation view of the ankle-supporting device of FIG. 1 shown in use by a user in inverted posture.

In FIG. 3 a user is shown suspended in inverted posture with ankles supported by supporting devices 1 and 1*a* according to the invention, with hooks 6 and 6*a* engaged on a horizontal bar 12 and with anterior extensions 5 and 5*a* resting against the metatarsal arches of the user, whereby the foot may not be withdrawn without employing a locking means 8.

In operation the ankle-supporting devices according to the invention, although generally cylindrical, closely match the contours of the human ankle, and with the inclusion of padding will distribute the load uniformly over a large area of the ankle and foot. The user may be suspended securely from a horizontal bar for inversion therapy or traction therapy, with or without a locking device, without danger of falling due to release of the foot from the ankle-supporting device.

The device according to the invention may be manufactured in a variety of materials within the scope of the invention, with no change in configuration or function required to employ metal, thermoplastics, fiberglass laminates, etc., and using fabrication processes which could include stamping, thermoforming, rotational or blow molding, as well as various laminating processes.

What is claimed is:

1. An ankle-supporting device for supporting a human in inverted posture comprising, a tubular clamp of generally cylindrical shape, configured of substantially rigid material so as to conform to the approximate shape of a human ankle;

a longitudinal slit along the anterior length of the tubular clamp;

an integral extension projecting in the anterior direction from each edge of the longitudinal slit, each extension including a hook means open in the proximal direction and adapted to receive a horizontal bar such that said hook means are secured against outward lateral movement by said horizontal bar; and a flexure portion integral with the posterior side of the tubular clamp, extending longitudinally, and having sufficient resilience to permit the hook means to be separated a distance at least the width of the human ankle for receiving the ankle into the tubular clamp.

2. An ankle-supporting device as in claim 1 in which the longitudinal slit is held closed by a locking means.

3. An ankle-supporting device as in claim 1 which is constructed of a single, unitary piece of material.

4. An ankle-supporting device as in claim 1 in which the interior surface of the tubular clamp is lined with a resilient padding material.

5. An ankle-supporting device as in claim 1 in which the hook means are adjacent to the user's metatarsal arch whereby there is not sufficient room for the foot to pass through the clamp when the hook means are engaged on a horizontal bar.

6. An ankle-supporting device for supporting a human in inverted posture comprising, a tubular clamp of generally cylindrical shape, configured of substantially rigid material so as to conform to the approximate shape of a human ankle;

a longitudinal slit along the anterior length of the tubular clamp;

an integral extension projecting in the anterior direction from each edge of the longitudinal slit, each extension including a hook means open upwardly adapted to receive a horizontal bar whereby said hook means are locked together preventing outward lateral movement of said edges of said tubular clamp when supporting a human upside down.

7. An ankle supporting device as in claim 6 which is constructed of a single, unitary piece of material.

8. An ankle supporting device as in claim 6 having a flexure portion integral with the posterior side of the tubular clamp, extending longitudinally, and having sufficient resilience to permit the hook means to be separated a distance at least the width of the human ankle.

* * * * *